US009580906B1

(12) United States Patent
Spencer

(10) Patent No.: US 9,580,906 B1
(45) Date of Patent: Feb. 28, 2017

(54) MODULAR INSULATED BUILDING PANELS

(71) Applicant: blokaloks, LLC, Sherwood, OR (US)

(72) Inventor: Stan Spencer, Sherwood, OR (US)

(73) Assignee: blokaloks, LLC, Sherwood, OR (US)

( * ) Notice: Subject to any disclaimer, the term of this patent is extended or adjusted under 35 U.S.C. 154(b) by 0 days.

(21) Appl. No.: 14/887,029

(22) Filed: Oct. 19, 2015

(51) Int. Cl.

| | |
|---|---|
| ***E04B 1/00*** | (2006.01) |
| ***E04G 21/00*** | (2006.01) |
| ***E04G 23/00*** | (2006.01) |
| ***E04B 2/00*** | (2006.01) |
| ***E04C 2/16*** | (2006.01) |
| ***E04C 2/20*** | (2006.01) |
| ***E04C 2/24*** | (2006.01) |
| ***E04C 2/34*** | (2006.01) |
| ***E04C 2/38*** | (2006.01) |
| *E04B 2/02* | (2006.01) |
| *E04B 2/08* | (2006.01) |
| *E04B 2/18* | (2006.01) |

(52) U.S. Cl.

CPC . *E04C 2/46* (2013.01); *E04C 2/16* (2013.01); *E04C 2/20* (2013.01); *E04C 2/243* (2013.01); *E04C 2/246* (2013.01); *E04C 2/34* (2013.01); *E04C 2/38* (2013.01); *E04B 2/08* (2013.01); *E04B 2/18* (2013.01); *E04B 2002/021* (2013.01); *E04B 2002/023* (2013.01); *E04B 2002/0206* (2013.01); *E04B 2002/0208* (2013.01); *E04B 2002/0215* (2013.01); *E04B 2002/0232* (2013.01); *E04B 2002/0234* (2013.01)

(58) Field of Classification Search

CPC ..... E04C 2/46; E04C 2/243; E04C 2/246; E04C 2/34; E04C 2/38

USPC ..... 52/572, 590.2, 223.7, 286, 745.03, 52/748.11, 741.1; 405/285

See application file for complete search history.

(56) References Cited

U.S. PATENT DOCUMENTS

| | | | | |
|---|---|---|---|---|
| 2,122,577 A | | 7/1938 | Mattes et al. | |
| 2,224,488 A | * | 12/1940 | Rendall | C03B 19/04 52/306 |
| 2,319,914 A | | 5/1943 | Blanding | |
| 2,351,768 A | * | 6/1944 | Kaping | E04B 2/08 52/189 |
| 2,544,983 A | | 3/1951 | Davis | |

(Continued)

FOREIGN PATENT DOCUMENTS

| | | |
|---|---|---|
| WO | WO 99/15737 | 4/1999 |

OTHER PUBLICATIONS

PDF of http://www.thermalshellhomes.com/building/html, SIP Construction Information for the Owner/Builder or Contractor, Thermal Shell Homes, 6 pages, archived Mar. 5, 2014.

*Primary Examiner* — Chi Q Nguyen

(74) *Attorney, Agent, or Firm* — Klarquist Sparkman, LLP

(57) ABSTRACT

A building panel includes an insulating member having a first surface and a second, opposing surface, and a first sheathing member secured to the first surface of the insulating member and including a coupling portion. The coupling portion has a recessed portion, a first extension portion adjacent the recessed portion, and a second extension portion on the opposite side of the recessed portion from the first extension portion. A sum of a width dimension of the first extension portion and a width dimension of the second extension portion is substantially equal to a width dimension of the recessed portion, and at least one side surface of the insulating member is substantially coplanar with a respective side surface of the first sheathing member.

20 Claims, 5 Drawing Sheets

(56) References Cited

U.S. PATENT DOCUMENTS 2,691,242 A 10/1954 Young
3,001,613 A 9/1961 McBerty
3,204,381 A * 9/1965 Perreton ..... E04B 2/46 52/309.12
3,623,261 A 11/1971 Freese
3,665,669 A * 5/1972 Huber ..... E04B 2/18 229/930
4,121,397 A * 10/1978 Marcocci ..... E04B 2/08 52/286
4,441,298 A 4/1984 Limousin
4,557,093 A * 12/1985 Beliveau ..... E04B 2/18 52/405.4
5,122,015 A * 6/1992 Shen ..... E02D 29/025 405/21
5,357,728 A 10/1994 Duncanson
6,105,330 A * 8/2000 Nanayakkara ..... E04B 2/14 52/590.2
6,244,009 B1 * 6/2001 Cerrato ..... E04B 2/08 52/223.7
6,418,686 B1 * 7/2002 Record ..... E04C 2/292 52/284
6,453,973 B1 9/2002 Russo
6,508,038 B2 * 1/2003 Al-Ghitta ..... E04B 2/16 405/284
6,539,682 B1 4/2003 Ryder
6,568,143 B2 5/2003 Coleman
6,588,161 B2 * 7/2003 Smith ..... E04B 2/702 52/223.7
7,155,865 B2 1/2007 Rosenberg
7,770,340 B2 8/2010 Heady et al.
7,963,038 B2 6/2011 Schmitz
8,448,396 B2 * 5/2013 Robertson ..... B32B 37/18 52/286
8,800,236 B2 8/2014 Yong et al.
2002/0043038 A1 * 4/2002 Cerrato ..... E04B 1/703 52/604
2005/0246998 A1 11/2005 Bennett
2007/0204548 A1 * 9/2007 Gagne ..... E04B 2/06 52/604
2013/0205703 A1 * 8/2013 Baumer ..... C04B 28/10 52/572
2014/0123583 A1 * 5/2014 Arriola Serrano ..... E04B 2/06 52/405.1

* cited by examiner

MODULAR INSULATED BUILDING PANELS

FIELD

The present application concerns modular building panels and methods of making and using the same.

BACKGROUND

Modular insulated building panels are useful for building structures relatively quickly and inexpensively. However, many prefabricated modular building panels such as Structural Insulated Panels ("SIPs") must be custom-fabricated at the factory based on a structure's design, which can require significant lead time. Additionally, such insulated building panels are often large, complicating transportation, and often must be positioned at a job site by skilled laborers using specialized equipment, such as a crane. Accordingly, improvements to building panels are desirable.

SUMMARY

Certain embodiments of the disclosure relate to building panels and methods of making and using the same. In a representative embodiment, a building panel comprises an insulating member having a first surface and a second, opposing surface, and a first sheathing member secured to the first surface of the insulating member and including a coupling portion. The coupling portion has a recessed portion, a first extension portion adjacent the recessed portion, and a second extension portion on the opposite side of the recessed portion from the first extension portion. A sum of a width dimension of the first extension portion and a width dimension of the second extension portion is substantially equal to a width dimension of the recessed portion, and at least one side surface of the insulating member is substantially coplanar with a respective side surface of the first sheathing member.

In another representative embodiment, a method of making a building panel comprises coupling a first sheathing member to a first side surface of an insulating member, the first sheathing member including a coupling portion having a recessed portion, a first extension portion adjacent the recessed portion, and a second extension portion on the opposite side of the recessed portion from the first extension portion. A sum of a width dimension of the first extension portion and a width dimension of the second extension portion is substantially equal to a width dimension of the recessed portion. The method further comprises coupling a second sheathing member to a second side surface of the insulating member opposite the first side surface such that the insulating member is disposed between the first and second sheathing members and at least one side surface of the insulating member is substantially coplanar with respective side surfaces of the first and second sheathing members. The second sheathing member includes a coupling portion having a recessed portion, a first extension portion adjacent the recessed portion, and a second extension portion on the opposite side of the recessed portion from the first extension portion. A sum of a width dimension of the first extension portion and a width dimension of the second extension portion of the second sheathing member is substantially equal to a width dimension of the recessed portion of the second sheathing member.

In another representative embodiment, a method of making a structure comprises situating a first building panel side by side with a second building panel, the first and second building panels comprising respective insulating members sandwiched between respective first and second sheathing members, the first and second sheathing members comprising respective upper and lower coupling portions located on opposite sides of the sheathing members from one another, the upper and lower coupling portions including respective first and second extension portions and recessed portions defined therebetween, a sum of the respective width dimensions of the first and second extension portions of each respective coupling portion being substantially equal to width dimensions of the respective recessed portions of the first and second sheathing members. At least one side surface of the respective insulating members is substantially coplanar with respective side surfaces of the first and second sheathing members of the first and second building panels. The method further comprises situating a third building panel on top of the first and second building panels such that respective lower coupling portions of first and second sheathing members of the third building panel engage the upper coupling portions of the first and second sheathing members of the first and second building panels.

The foregoing and other objects, features, and advantages of the disclosure will become more apparent from the following detailed description, which proceeds with reference to the accompanying figures.

DETAILED DESCRIPTION

Figure 1:
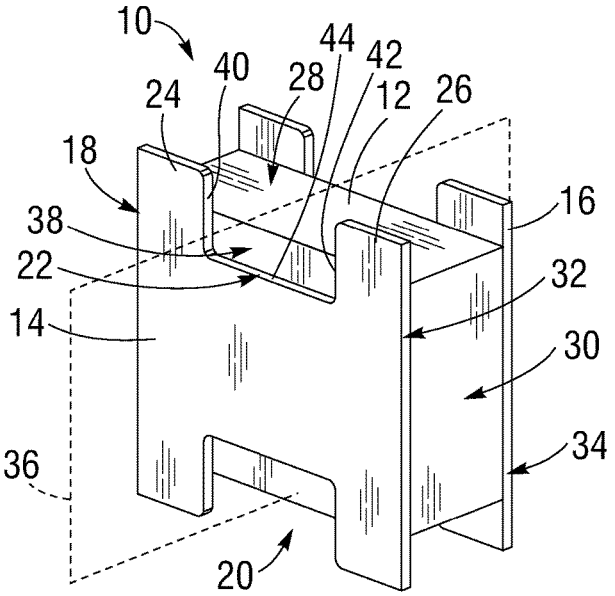
FIG. 1 is a perspective view of a representative embodiment of a building panel.

FIG. 1 illustrates a representative embodiment of a building panel 10 comprising an insulating member 12 disposed between first and second facing or sheathing members 14, 16. The first sheathing member 14 can be coupled to a first side surface 38 of the insulating member 12, and the second sheathing member 16 can be coupled to a corresponding second surface of the insulating member opposite the first surface. Each of the sheathing members 14, 16 can include first and second coupling portions 18, 20 located opposite one another that allow the building panel to be coupled to other similar building panels to form a structure, as further described below. In certain examples, the first and second coupling portions 18, 20 can be the same as, or complementary to, one another.

Figure 2:
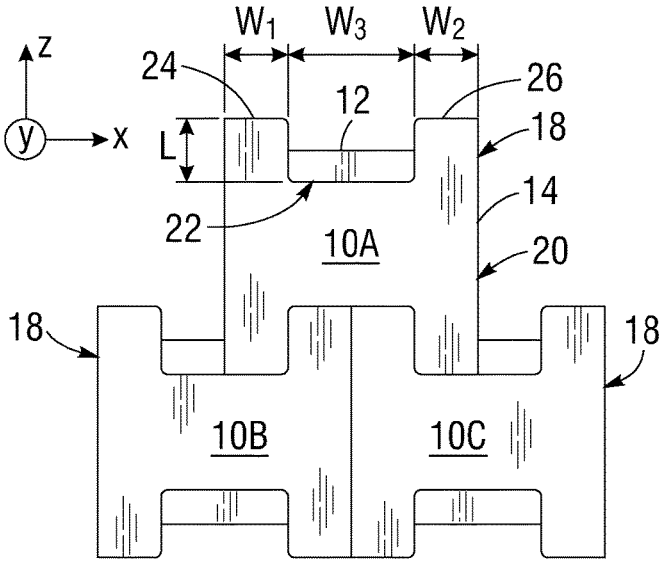
FIG. 2 and 3 are side elevation views of embodiments of three building panels of FIG. 1 coupled to one another in a stacked arrangement.

Referring to the first coupling portion 18 for ease of illustration, the coupling portion can include a cutout or recessed portion 22, and can include first and second extension portions 24, 26 located adjacent the recessed portion and on opposite sides of the recessed portion from one another. The recessed portion 22 can be defined by inner side surfaces 40, 42 of the extension portions 24, 26, respectively, and a lower horizontal surface 44. With reference to FIG. 2, the extension portions 24, 26 can have a length dimension L and width dimensions $W_1$ and $W_2$, respectively. In the illustrated embodiment, the length dimension L of the extension portions can be substantially the same as a depth of the recessed portion 22. The recessed portion can also define a width dimension $W_3$. The width dimensions $W_1$ and $W_2$ of the extension portions 24, 26 can be substantially equal to one another, and together can be substantially equal to the width dimension $W_3$ of the recessed portion 22.

For example, in the embodiment of FIG. 1, each of the width dimensions $W_1$, $W_2$ of the extension portions can be about half the width dimension $W_3$ of the recessed portion 22. In this manner, with reference to FIG. 2, the building panels 10 can be coupled to one another in a stacked arrangement wherein the second coupling portions 20 (e.g., lower coupling portions) of the sheathing members of a building panel 10A in an upper row of building panels partially overlap the first coupling portions 18 (e.g., upper coupling portions) of the sheathing members of two adjacent building panels 10B, 10C in a lower row.

More specifically, an upper extension portion of each of the sheathing members of panel 10B and an upper extension portion of each of the sheathing members of panel 10C can be received in the respective lower recessed portions of the sheathing members of panel 10A. Further, a lower extension portion of each of the sheathing members of panel 10A can be received in the corresponding upper recessed portions of the sheathing members of panel 10B, and the other of the lower extension portions of each of the sheathing members of panel 10A can be received in the upper recessed portions of the sheathing members of panel 10C. The building panels are thereby interlockable with one another such that the extension portions of one building panel engage the recessed portions of adjacent panels. With reference to the coordinate axes of FIG. 2, this interlocking arrangement can reduce or prevent lateral motion of the building panels with respect to one another along the X-axis. The extension portions of a building panel can also overlap the insulating members 12 of the adjacent building panels when received in the respective recessed portions 22 to provide stability along the Y-axis.

Figure 3:
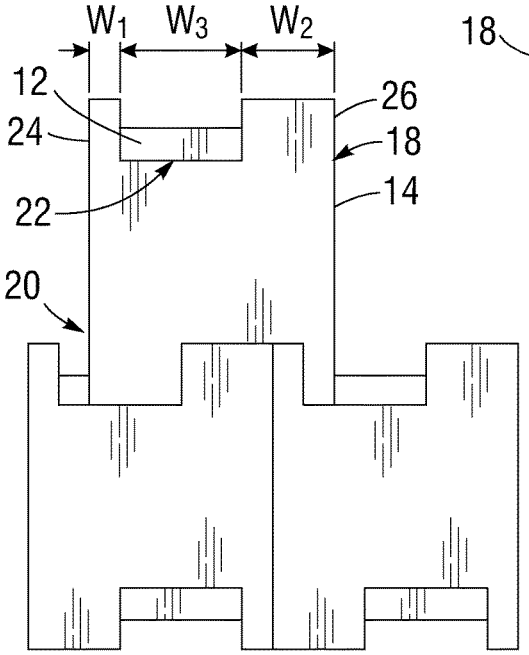

Alternatively, the widths $W_1$, $W_2$ of the extension portions can be unequal, and can be any suitable proportion of the width $W_3$ of the recessed portion, provided that the sum of the widths $W_1$ and $W_2$ substantially equals the width $W_3$ of the recessed portion. FIG. 3 illustrates an exemplary embodiment wherein the width dimension $W_1$ of the extension portion 24 is about 25% of the width dimension $W_3$ of the recessed portion 22, and the width dimension $W_2$ of the extension portion 26 is about 75% of the width dimension $W_3$ of the recessed portion. With respect to the lower coupling portion 20, the widths of the extension portions can be reversed relative to the extension portions 24, 26 of the coupling portion 18 such that the building panels can be stacked in the manner described above. Although the extension portions 24, 26 in the illustrated embodiment have substantially equal length dimensions L, it should be understood that in some embodiments the length dimensions of the extension portions 24, 26 can also be unequal.

Referring again to the first coupling portion 18 of FIG. 1, the insulating member 12 can be positioned such that an upper surface 28 extends beyond the lower surface 44 of the insulating member 12. For example, in the embodiment of FIG. 1, the upper surface 28 of the insulating member is located about midway along the length L of the extension portions 24, 26. It should be understood, however, that the upper surface 28 of the insulating member can be located at any suitable position along the length of the extension portions 24, 26. In some embodiments, a lower surface of the insulating member 12 can also extend beyond the respective surface of the recessed portion of the second coupling portion 20 such that the first and second coupling portions are symmetrical. In this manner, when the building panels are assembled, the insulating members can contact one another such that gaps between layers of building panels are minimized.

As best illustrated in FIG. 1, the insulating member 12 can also be configured such that a side surface 30 of the insulating member is substantially coplanar with respective side surfaces 32, 34 of the first and second sheathing members 14, 16. This can help to reduce heat loss by minimizing gaps between insulating members of adjacent building panels. In some embodiments, both side surfaces of the insulating member can be substantially coplanar with the respective side surfaces of the sheathing members. However, in other embodiments, one or both of the side surfaces of the insulating member can be offset (e.g., inwardly) from the respective side surfaces of the sheathing members to accommodate, for example, boards or beams situated between groupings of panels.

Respective edges of insulating members between adjacent layers of building panels can also be offset from one another in a direction along the Y-axis by one-half of the width of a building panel, creating a tortuous path between insulating members in adjacent layers of building panels and further reducing heat loss. In some embodiments, caulking such as polyurethane caulking can be applied to the mating surfaces of insulating members between rows of building panels, and/or between panels in the same row to eliminate air gaps between building panels and reduce heat loss.

Figure 9:
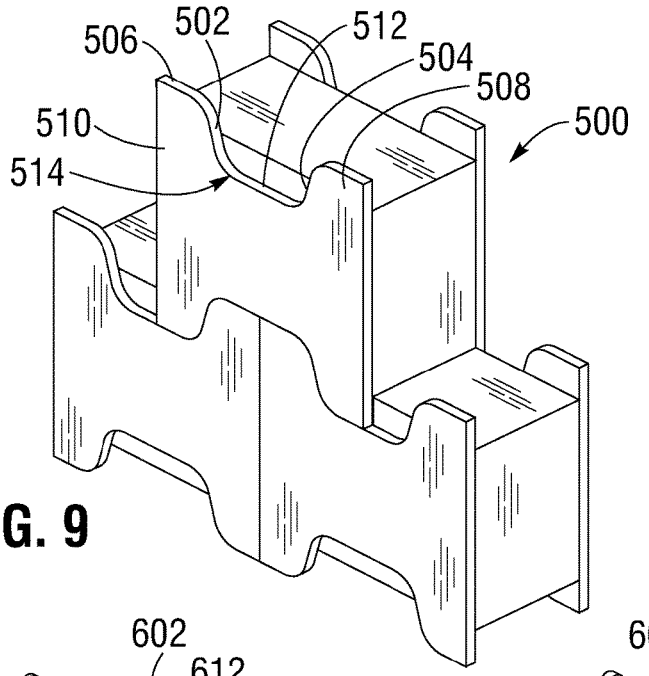
FIG. 9 illustrates an alternative embodiment of the building panel of FIG. 1 wherein the side walls of the recessed portion are angled.

In the embodiment of FIG. 1, the corners of the recessed portion 22, along with the corners of the extension portions 24, 26 adjacent the recessed portion, can be rounded or radiused to facilitate ease of assembly. The corners can have any suitable radius. The inner side surfaces 40, 42 of the extension portions 24, 26 can also be substantially perpendicular to the lower surface 44 of the recessed portion 22, as in the embodiment of FIG. 1, or angled. For example, FIG. 9 illustrates building panels 500 wherein inner side surfaces 502, 504 of the extension portions 506, 508 of the first sheathing member 510 are angled with respect to the lower surface 512 of the recessed portion 514. This can promote ease of assembly because the sloped inner side surfaces 502, 504 can guide the extension portions of adjacent building panels into the recessed portion, reducing the degree of alignment required to fit the building panels together.

Figure 4:
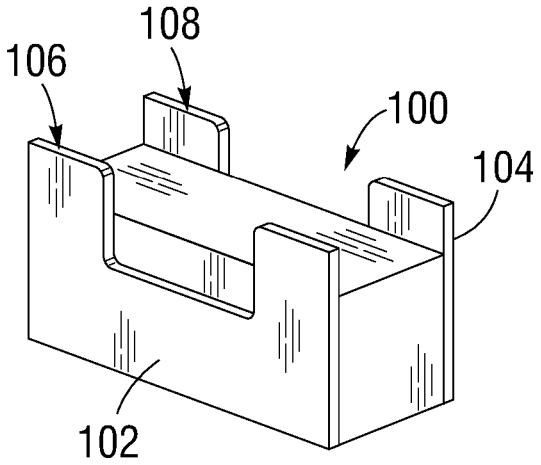
FIG. 4 is a perspective view of another embodiment of a building panel comprising an upper portion of the building panel of FIG. 1.

In some embodiments, the building panel of FIG. 1 can be combined with other building panels comprising only a portion of the structure of the building panel of FIG. 1. For example, FIG. 4 illustrates another embodiment of a building panel 100 wherein the sheathing members 102, 104 each comprise a single coupling portion 106, 108, respectively.

Figure 5:
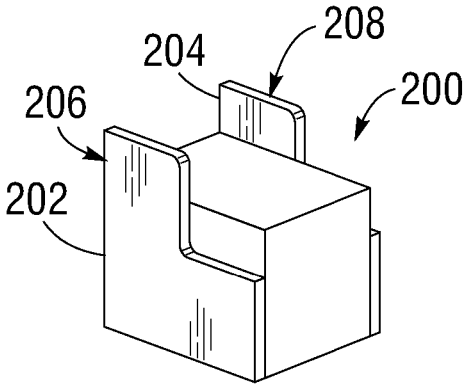
FIG. 5 is a perspective view of another embodiment of a building panel comprising a corner portion of the building panel of FIG. 1.
Figure 6:
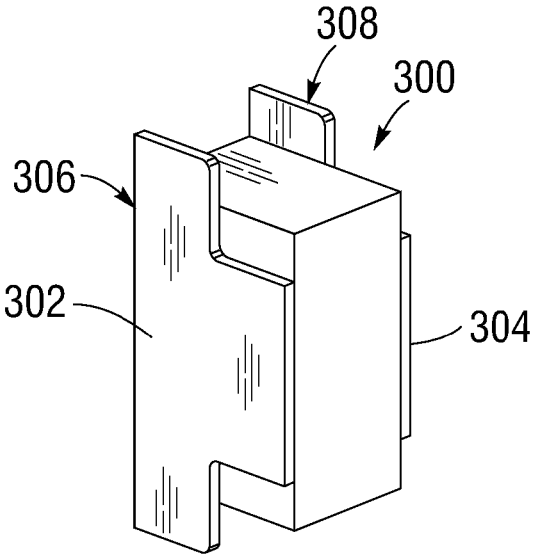
FIG. 6 is a perspective view of another embodiment of a building panel comprising half of a first coupling portion and half of a second coupling portion.

By way of further example, FIG. 5 illustrates another building panel 200 wherein the sheathing members 202, 204 each include only a portion (e.g., half) of respective coupling portions 206, 208. In another example illustrated in FIG. 6, a building panel 300 can be created by cutting the building panel of FIG. 1 along the plane indicated at 36 such that sheathing members 302, 304 each comprise a portion (e.g., half) of a first coupling portion 306 and a portion (e.g., half) of a second coupling portion 308. Such building panels can be used in combination with the building panels 10 to form, for example, openings of various sizes for windows, doorways, etc. The above building panels can be made in a dedicated process, or cut from the buildings panels of FIG. 1 at, for example, a construction site, as needed.

In some examples, the sheathing members 14, 16 can be made from relatively thin pieces of material exhibiting suitable strength properties. For example, the sheathing members can be made from wood such as plywood or oriented strand board, metals such as aluminum or steel, stone, any of various ceramic materials, fiber-reinforced polymer composites such as fiber glass, aramid fibers (e.g., Kevlar®), or carbon fiber, concrete, fiber-reinforced cementitious materials such as HardiePlank®, or combinations thereof. In this manner, one or both of the sheathing members can serve as load-bearing members in a structure, allowing the building panels to be used in, for example, exterior or interior walls, floors, roofs, etc. In alternative embodiments, the building panel 10 need only comprise one sheathing member (e.g., an exterior sheathing member), as desired. Additionally, in certain embodiments other materials may be applied to the sheathing members to present a finished appearance. For example, wood paneling, drywall, etc., may be applied (e.g., with adhesive or fasteners) to the sheathing members on the interior of a structure to present a finished wall, ceiling, or floor. The sheathing members can also comprise multiple layers of different materials depending on the desired characteristics, or multiple discrete sheathing members on each side of the insulating member. For example, in some embodiments the sheathing members can include a layer of ballistic material such as Kevlar® alone, or in addition to other materials.

In the illustrated embodiment, the insulating member 12 is substantially rectangular, and can be made from any suitable insulating material, such as any of various polymers including expanded polystyrene, extruded polystyrene foam, polyisocyanurate foam, polymer-based honeycomb materials, or polyurethane foam, fibers such as mineral wool, glass, or aramid fibers, natural fibers such as straw, etc. In certain embodiments, the insulating member can comprise an evacuated chamber, such as a substantially airtight evacuated fiberglass chamber. In other embodiments, the insulating member can comprise a substantially non-flammable material, such as aerated stone materials or pumice stone. When combined with sheathing members comprising non-flammable materials (e.g., metal), the entire building panel 10 can be substantially non-flammable.

In certain examples, the sheathing members 14, 16 can be secured to the insulating member by, for example, adhesive, fasteners such as dowels, or combinations thereof. In other examples, the sheathing members can be incorporated into a mold, and liquid insulating material (e.g., a foamed polymer) can be introduced into the mold between the sheathing members such that the insulating material adheres to the sheathing members. Reinforcement can also be provided between the sheathing members 14, 16 (e.g., along the Y-axis of FIG. 2) by, for example, internal support members, trusses, etc., extending between the sheathing members through the insulating member to increase the strength of the building panel in the direction normal to the surfaces of the sheathing members.

Figure 7:
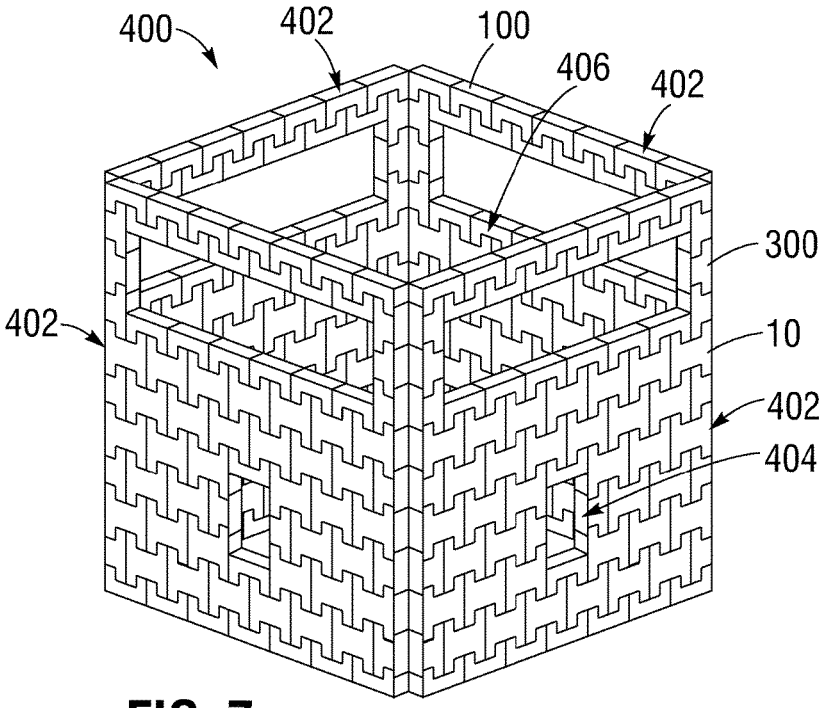
FIGS. 7 and 8 are perspective views of a structure including the building panels of FIGS. 1,4, and 6.
Figure 8:
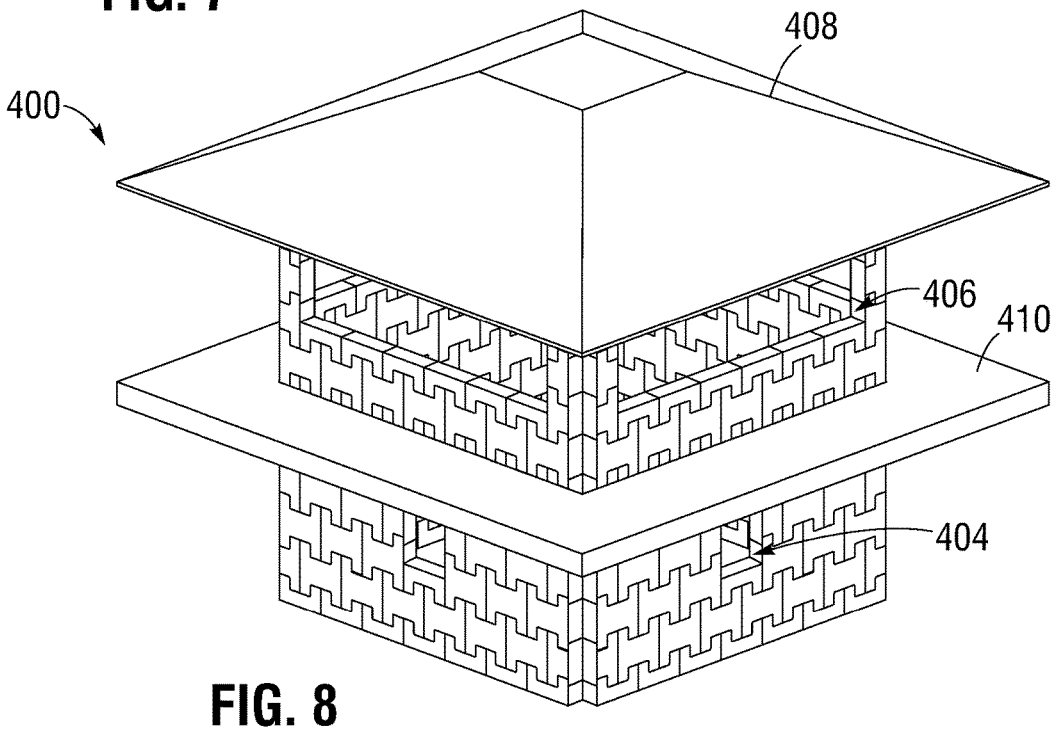

The building panels of FIGS. 1 and 4-6 above can be combined to create structures including openings of various shapes and sizes. For example, FIGS. 7 and 8 illustrate a structure 400 including walls 402, with building panels 10, 100, and 300 being arranged to create openings 404 for doors and openings 406 for windows. In some examples, the walls 402 can be joined together by, for example, metal brackets, or by boards inserted between adjacent walls in combination with fasteners such as screws or panel fasteners. In certain embodiments, building panels in the same row can be fastened to one another, or to building panels in adjacent rows, as desired. FIG. 8 illustrates the structure 400 including a roof 408 and a floor 410 of a second story, either or both which may be constructed using the building panels described herein.

Due to the stackable nature of the building panel 10 and its variants, the time required to build a structure can be reduced over known building panels. Additionally, because the number and shape of panels required to form openings for windows, doors, etc., can be determined in advance, material waste can be reduced, along with the need to modify building panels at the job site. The building panels can also be light-weight, and sized such that they can be lifted by an individual. Thus, no special skills or equipment are required to assemble a structure.

The combination of the rigid sheathing members and the insulative member also allow easy assembly of a thermally efficient, passive structure. Onsite labor can be further reduced by fabricating the sheathing members to be located on the outside of the structure from high-strength materials such as HardiePlank®, and applying drywall to the sheathing members intended to be located on the interior of the structure. This can eliminate the need to add exterior siding and interior drywall at the building site. Rather, caulking of the exterior joints and application of a joint compound to the interior joints between building panels is all that is required to provide a finished appearance.

The light-weight and modular nature of the building panels can also provide safety advantages over known building materials during, for example, seismic events. If a seismic event is sufficiently energetic that a structure comprising the disclosed building panels topples, the building panels can separate from one another, potentially reducing the harm to occupants, especially as compared to masonry structures.

An additional advantage of the disclosed building panels over traditional SIP panels, which are typically fabricated with a height corresponding to the height of an entire story of a building, is that they can be more easily transported. Thus, the disclosed building panels can be especially useful for building structures in remote locations inaccessible to large transport vehicles and/or construction equipment. For example, the building panels described herein can be packaged for delivery by air for military or disaster relief applications. The building panels can also be easily disassembled, making the panels suitable for temporary structures such as school expansion buildings, temporary shelters, traffic or floodwater barriers, etc.

The length, width, and thickness dimensions of the building panels can be varied as desired, depending upon the intended application. For example, the thickness of the insulating member can be varied according to the desired thermal or acoustic insulation properties. The materials from which the sheathing members are made can also be selected based upon the intended application. For example, exterior sheathing members made from polished steel can be used to achieve a mirror-like finish for, e.g., designer home applications or for camouflage. Selection of metallic materials for the sheathing members can also be used to construct a radiopaque structure to protect interior occupants or equipment from radiation or radio frequency interference.

The disclosed building panels also offer flexibility in the size of the structure that may be produced. Because the size of walls constructed with the disclosed building panels can be scalable by incorporating more or fewer building panels, the building panels described herein can be suitable for building small structures such as tiny houses, sheds, and children's playhouses, or larger structures such as houses, barns, or multi-story buildings. Due to the scalable size of the disclosed building panels, they can also be useful in other applications such as in children's toys.

Figure 10:
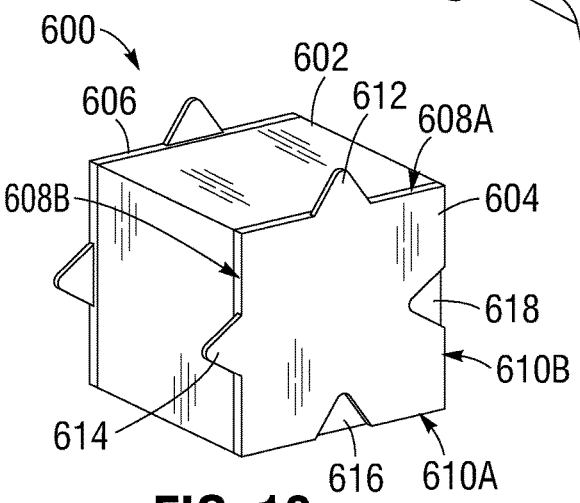
FIGS. 10-12 are perspective views of alternative embodiments of building panels.
Figure 11:
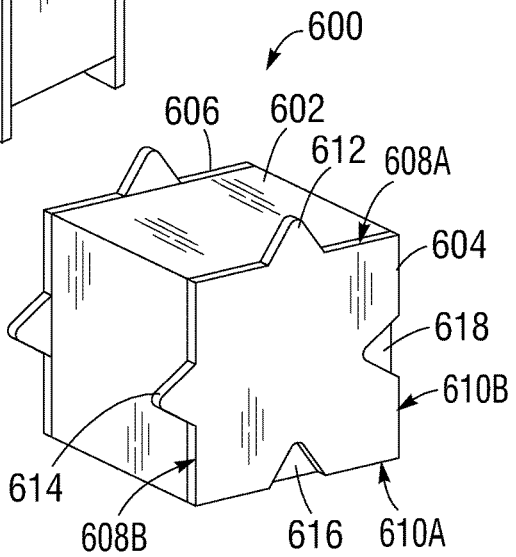
Figure 12:
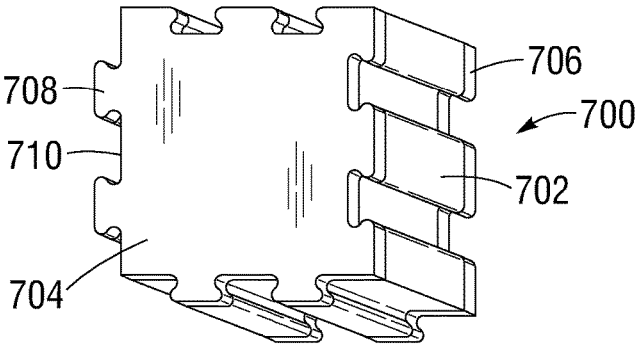

FIGS. 10-12 illustrate alternative embodiments of building panels. FIG. 10 illustrates a building panel 600 including an insulating member 602 and first and second sheathing members 604, 606. Referring to the sheathing member 604 for ease of illustration, the sheathing member can include first coupling portions 608A, 608B and second coupling portions 610A, 610B. The first coupling portions 608A, 608B, can include substantially triangular extension portions 612, 614 extending normal to one another. The second coupling portions 610A, 610B can include corresponding recessed portions 616, 618. The recessed portion 616 can extend in a direction parallel to the extension portion 612, and the recessed portion 618 can extend in a direction parallel to the extension portion 614. In this manner, when the building panels are assembled together, the extension portion 612 can engage the recessed portion 616 of an adjacent building panel, and the extension portion 614 can engage the recessed portion 618 of an adjacent building panel such that the building panels are interlocked.

FIG. 11 illustrates an alternative embodiment of the building panel 600 of FIG. 8 in which the extension portions 612, 614 and the recessed portions 616, 618 comprise only a portion of the thickness of the respective sheathing members. For example, in the illustrated embodiment the extension portions 612, 614 have a thickness of about half the overall thickness of the sheathing member, and the recessed portions 616, 618 have a corresponding depth of about half the thickness of the sheathing member, with the extension portions being outwardly offset from the recessed portions relative to the insulating member. Thus, when the building panels are assembled together, the extension portions 612, 614 overlap the recessed portions 616, 618 such that an exterior surface of the recessed portions can contact an interior surface of the extension portions.

FIG. 12 illustrates another embodiment of a building panel 700 including an insulating member 702 disposed between two sheathing members 704, 706. The sheathing members and the insulating member can comprise a plurality of alternating extension portions 708 and recessed portions 710 located along the perimeter of the building panel in the manner of a jigsaw puzzle, and can be assembled together by inserting the extension portions into the corresponding recessed portions along the Y-axis (see FIG. 2). In certain embodiments, the extension portions 708 and the recessed portions 710 can vary in size, shape, and/or location along the perimeter of the building panel, as desired.

Figure 13:
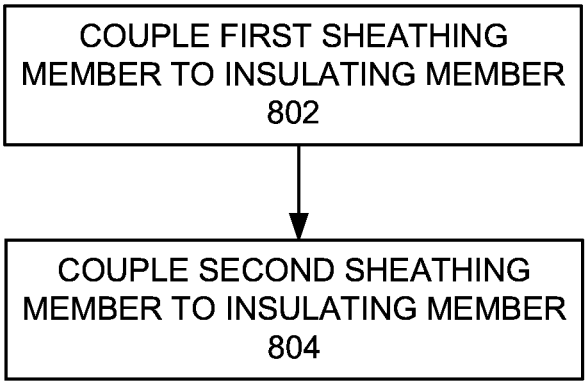
FIG. 13 is a block diagram schematically illustrating a representative method of making the building panel of FIG. 1.

A representative method of making the building panel of FIG. 1 will now be described with reference to FIG. 13. In a first step 802, a first sheathing member including first and second coupling portions can be coupled to an insulating member.

In a second step 804, a second sheathing member including first and second coupling portions can be coupled to the insulating member opposite the first sheathing member such that the insulating member is disposed between the first and second sheathing members and a side surface of the insulating member is substantially coplanar with respective side surfaces of the first and second sheathing members. The first and second sheathing members can be coupled to the insulating member by adhesive, fasteners, or combinations thereof, as described above.

Figure 14:
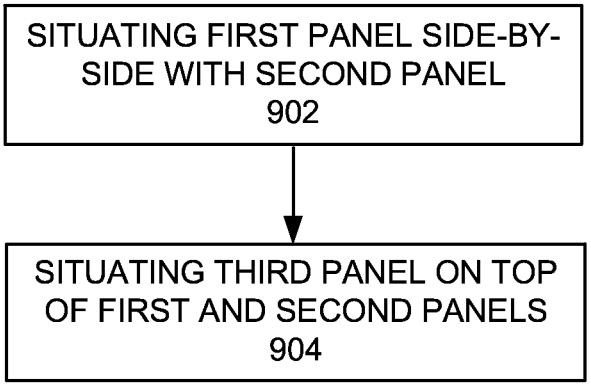
FIG. 14 is a block diagram schematically illustrating a representative method of making a structure including the building panel of FIG. 1.

With reference to FIG. 14, a first step 902 of a method of making a structure can comprise situating a first building panel side by side with a second building panel. The first and second building panels can include respective insulating members sandwiched between respective first and second sheathing members including respective upper and lower coupling portions. The upper and lower coupling portions can include respective first and second extension portions and recessed portions defined therebetween, and respective side surfaces of the insulating members can be substantially coplanar with respective side surfaces of the first and second sheathing members of the first and second building panels.

In a second step 904, a third building panel can be situated on top of the first and second building panels such that the lower coupling portions of the first and second sheathing members of the third building panel engage the upper coupling portions of the respective first and second sheathing members of the first and second building panels. In some embodiments, caulking (e.g., polyurethane caulking) can be applied to the mating surfaces of the respective insulating members of the first, second, and third building panels before placement of the third building panel.

As used herein with respect to the sum of the width dimensions of the extension portions, the term "substantially equal" means that the sum of the width dimension $W_1$ of the extension portion 24 and the width dimension $W_2$ of the extension portion 26 is at least 90% of the width dimension $W_3$ of the recessed portion 22. In some embodiments, the sum of the width dimension $W_1$ of the extension portion 24 and the width dimension $W_2$ of the extension portion 26 can be at least 95%, at least 98%, at least 99%, or 100% of the width dimension $W_3$ of the recessed portion 22.

As used herein with respect to the width dimensions of the extension portions as compared to one another, "substantially equal" means that the width dimension $W_1$ of the extension portion 24 is at least 90% of the width dimension $W_2$ of the extension portion 26. In some embodiments, the width dimension $W_1$ of the extension portion 24 can be about 95%, about 98%, about 99%, or 100% of the width dimension $W_2$ of the extension portion 26.

As used herein, the term "substantially coplanar" means that the side surface of the insulating member and the respective side surface of the sheathing member are offset from one another by not more than 2 inches. In some embodiments, the side surface of the insulating member and the respective side surface of the sheathing member can be offset from one another by not more than 1 inch, by not more than ½ inch, by not more than ¼ inch, or by not more than ⅛ inch.

General Considerations

For purposes of this description, certain aspects, advantages, and novel features of the embodiments of this disclosure are described herein. The disclosed methods, apparatus, and systems should not be construed as being limiting in any way. Instead, the present disclosure is directed toward all novel and nonobvious features and aspects of the various disclosed embodiments, alone and in various combinations and sub-combinations with one another. The methods, apparatus, and systems are not limited to any specific aspect or feature or combination thereof, nor do the disclosed embodiments require that any one or more specific advantages be present or problems be solved.

Although the operations of some of the disclosed embodiments are described in a particular, sequential order for convenient presentation, it should be understood that this manner of description encompasses rearrangement, unless a particular ordering is required by specific language set forth below. For example, operations described sequentially may in some cases be rearranged or performed concurrently. Moreover, for the sake of simplicity, the attached figures may not show the various ways in which the disclosed methods can be used in conjunction with other methods. Additionally, the description sometimes uses terms like "provide" or "achieve" to describe the disclosed methods. These terms are high-level abstractions of the actual operations that are performed. The actual operations that correspond to these terms may vary depending on the particular implementation and are readily discernible by one of ordinary skill in the art.

As used in this application and in the claims, the singular forms "a," "an," and "the" include the plural forms unless the context clearly dictates otherwise. Additionally, the term "includes" means "comprises." Further, the terms "coupled" and "associated" generally mean electrically, electromagnetically, and/or physically (e.g., mechanically or chemically) coupled or linked and does not exclude the presence of intermediate elements between the coupled or associated items absent specific contrary language.

Some of the Figures provided herein include an orientation system that designates the X-axis, the Y-axis, and the Z-axis that are orthogonal to each other. In these Figures, the Z-axis is oriented in the vertical direction. It should be understood that the orientation system is merely for reference and can be varied. For example, the X-axis can be switched with the Y-axis and/or the stage assembly 10 can be rotated.

In some examples, values, procedures, or apparatus may be referred to as "lowest," "best," "minimum," or the like. It will be appreciated that such descriptions are intended to indicate that a selection among many alternatives can be made, and such selections need not be better, smaller, or otherwise preferable to other selections.

In the following description, certain terms may be used such as "up," "down," "upper," "lower," "horizontal," "vertical," "left," "right," and the like. These terms are used, where applicable, to provide some clarity of description when dealing with relative relationships. But, these terms are not intended to imply absolute relationships, positions, and/or orientations. For example, with respect to an object, an "upper" surface can become a "lower" surface simply by turning the object over. Nevertheless, it is still the same object.

In view of the many possible embodiments to which the principles of the disclosed technology may be applied, it should be recognized that the illustrated embodiments are only preferred examples and should not be taken as limiting the scope of the disclosure. Rather, the scope of the disclosure is defined by the following claims.

What is claimed is:

1. A building panel, comprising:

an insulating member having a first surface and a second, opposing surface;

a first sheathing member secured to the first surface of the insulating member and including a coupling portion, the coupling portion having a recessed portion, a first extension portion adjacent the recessed portion, and a second extension portion on the opposite side of the recessed portion from the first extension portion;

wherein a sum of a width dimension of the first extension portion and a width dimension of the second extension portion is substantially equal to a width dimension of the recessed portion;

wherein at least one side surface of the insulating member is substantially coplanar with a respective side surface of the first sheathing member; and wherein at least a portion of the recessed portion is coplanar with an exterior surface of the first sheathing member.

2. The building panel of claim 1, wherein the recessed portion further comprises radiused corners.

3. The building panel of claim 2, wherein respective inner side surfaces of the first and second extension portions are angled with respect to a lower surface of the recessed portion.

4. The building panel of claim 1, wherein the coupling portion is a first coupling portion, and the first sheathing member further comprises a second coupling portion opposite the first coupling portion.

5. The building panel of claim 4, further comprising a second sheathing member secured to the second surface of the insulating member opposite the first sheathing member, the second sheathing member comprising first and second coupling portions including respective first and second extension portions and recessed portions defined therebetween.

6. The building panel of claim 1, wherein a respective surface of the insulating member is located beyond a horizontal surface of the first sheathing member defining the recessed portion.

7. The building panel of claim 1, wherein the respective width dimensions of the first and second extension portions are substantially equal.

8. The building panel of claim 1, wherein the respective width dimensions of the first and second extension portions are unequal.

9. The building panel of claim 1, wherein the first sheathing member comprises wood, metal, stone, ceramic, fiber-reinforced polymer composite, fiber-reinforced cementitious material, or any combination thereof.

10. The building panel of claim 1, wherein the insulating member comprises expanded or extruded polystyrene, polyurethane, fiberglass, pumice, mineral wool, polymer-based honeycomb materials, straw, or any combination thereof.

11. The building panel of claim 1, wherein the insulating member defines a substantially airtight evacuated vacuum chamber.

12. The building panel of claim 1, wherein the first sheathing member is secured to the insulating member by adhesive, fasteners, or any combination thereof.

13. A structure including the building panel of claim 1.

14. A method of making a building panel, comprising:

coupling a first sheathing member to a first side surface of an insulating member, the first sheathing member including a coupling portion having a recessed portion, a first extension portion adjacent the recessed portion, and a second extension portion on the opposite side of the recessed portion from the first extension portion, a sum of a width dimension of the first extension portion and a width dimension of the second extension portion being substantially equal to a width dimension of the recessed portion, wherein at least a portion of the recessed portion is coplanar with an exterior surface of the first sheathing member;

coupling a second sheathing member to a second side surface of the insulating member opposite the first side surface such that the insulating member is disposed between the first and second sheathing members and at least one side surface of the insulating member is substantially coplanar with respective side surfaces of the first and second sheathing members, the second sheathing member including a coupling portion having a recessed portion, a first extension portion adjacent the recessed portion, and a second extension portion on the opposite side of the recessed portion from the first extension portion, a sum of a width dimension of the first extension portion and a width dimension of the second extension portion being substantially equal to a width dimension of the recessed portion.

15. The method of claim 14, wherein coupling the second sheathing member further comprises coupling the second sheathing member such that a respective surface of the insulating member extends beyond respective horizontal surfaces of the recessed portions of the first and second sheathing members.

16. The method of claim 14, wherein coupling the first and second sheathing members further comprises coupling the first and second sheathing members to the insulating member with adhesive, fasteners, or any combination thereof.

17. The method of claim 14, wherein coupling the first and second sheathing members further comprises injecting liquid insulation between the sheathing members to form the insulating member.

18. The method of claim 14, wherein the sheathing members comprise wood, metal, stone, ceramic, fiber-reinforced polymer composite, fiber-reinforced cementitious material, or any combination thereof.

19. The method of claim 14, wherein the insulating member comprises expanded or extruded polystyrene, polyurethane, fiberglass, pumice, mineral wool, polymer-based honeycomb materials, straw, or any combination thereof.

20. A method of making a structure, comprising:

situating a first building panel side by side with a second building panel, the first and second building panels comprising respective insulating members with respective first and second sheathing members coupled to first and second surfaces of the insulating members, the first and second sheathing members comprising respective upper and lower coupling portions located on opposite sides of the sheathing members from one another, the upper and lower coupling portions including respective first and second extension portions and recessed portions defined therebetween, a sum of the respective width dimensions of the first and second extension portions of each respective coupling portion being substantially equal to width dimensions of the respective recessed portions of the first and second sheathing members, at least one side surface of the respective insulating members being substantially coplanar with respective side surfaces of the first and second sheathing members coupled thereto, wherein at least a portion of each respective coupling portion is coplanar with an exterior surface of the respective sheathing member; and situating a third building panel on top of the first and second building panels such that respective lower coupling portions of first and second sheathing members of the third building panel engage the upper coupling portions of the first and second sheathing members of the first and second building panels.

* * * * *